US005827010A

United States Patent [19]

Hassett

[11] Patent Number: 5,827,010

[45] Date of Patent: Oct. 27, 1998

[54] ON-SITE SEWAGE TREATMENT AND DISPOSAL SYSTEM

[75] Inventor: Alan F. Hassett, Berwyn, Pa.

[73] Assignee: The English Oak Partnership, L.P., Berwyn, Pa.

[21] Appl. No.: 822,252

[22] Filed: Mar. 20, 1997

[51] Int. Cl.[6] ..... B09B 3/00

[52] U.S. Cl. ..... 405/36; 405/128

[58] Field of Search ..... 405/128, 129, 405/267, 52, 53, 36, 37, 42, 45, 50; 588/259, 260

[56] References Cited

U.S. PATENT DOCUMENTS

| | | | |
|---|---|---|---|
| 4,808,039 | 2/1989 | Fischer | 405/128 X |
| 4,850,745 | 7/1989 | Hater et al. | 405/128 X |
| 5,022,786 | 6/1991 | Philo | 405/128 |
| 5,054,961 | 10/1991 | Sherman | 405/128 |
| 5,246,309 | 9/1993 | Hobby | 210/615 X |
| 5,345,034 | 9/1994 | Corey | 588/249 |
| 5,435,666 | 7/1995 | Hassett et al. . | |
| 5,588,490 | 12/1996 | Suthersan et al. | 166/370 |
| 5,660,500 | 8/1997 | Marsden et al. | 405/267 X |

*Primary Examiner*—Dennis L. Taylor
*Attorney, Agent, or Firm*—Panitch Schwarze Jacobs & Nadel, P.C.

[57] ABSTRACT

An on-site sewage treatment and disposal system for areas having a ground water level above a minimum depth below grade is provided. The system includes a perimeter barrier arranged around a selected subterraneal volume. A drainage pipe which is adapted to receive fluid is provided. The drainage pipe is at least partially located within the selected subterraneal volume inside the perimeter barrier. A pump having a gas intake and a discharge side which discharges gas at a pressure greater than atmospheric pressure is also provided. The discharge side of the pump is in fluid communication with the selected subterraneal volume to lower the ground water level within the perimeter barrier to a level at or below the minimum depth below grade. A method for on-site wastewater disposal is also provided utilizing the treatment and disposal system.

20 Claims, 4 Drawing Sheets

ON-SITE SEWAGE TREATMENT AND DISPOSAL SYSTEM

BACKGROUND OF THE INVENTION

The present invention relates to on-site sewage treatment systems, and more particularly to below grade on-site leach fields for areas having high ground water.

Septic tanks with a leach or drainage field are commonly used in areas without public sewer systems. A septic tank in a private waste disposal system receives household sewage, and separates the solid matter from effluent before the effluent is discharged. Bacteria in the septic tank decomposes or digests the sewage. The effluent is discharged to a drainage or leach field, typically composed of underground perforated PVC piping or drainage tiles that distribute the liquid effluent into the earth, where additional bacterial action takes place.

Public health agencies and zoning codes for specific areas generally dictate the conditions for the installation of a septic system as described above, and require a certain range of perc rates for the soil as well as a minimum depth below grade to ground water (which provides a minimum thickness of unsaturated soil) in order to allow the leach field to operate in its intended manner.

Below grade leach field installations are generally not permitted in areas where the natural ground water level is too high. While the specific requirements may vary from state to state, or by local jurisdictions and municipalities, generally, the ground water level must be at least five feet below grade in order to obtain a permit for installation of a leach field.

One known solution to this problem is to install an elevated sand mound (a.k.a. "Wisconsin Mound") above grade and place the leach field in the sand mound. A pump is then used to transfer effluent from the septic tank to the leach field. However, sand mounds are much more costly to install than a below grade drain field, and have an undesirable appearance.

It would therefore be desirable to provide a lower cost alternative to a sand mound drainage field, as well as provide a more aesthetically pleasing appearance by eliminating the need for an above grade mound in areas having a high natural ground water level.

SUMMARY OF THE INVENTION

Briefly stated, the present invention provides an on-site sewage treatment and disposal system for areas having a ground water level above a minimum depth below grade. The system includes a perimeter barrier arranged around a selected subterraneal volume. A drainage pipe which is adapted to receive fluid is provided. The drainage pipe is at least partially located within the selected subterraneal volume inside the perimeter barrier. A pump having a gas intake and a discharge side which discharges gas at a pressure greater than atmospheric pressure is also provided. The discharge side of the pump is in fluid communication with the selected subterraneal volume to lower the ground water level within the perimeter barrier to a level at or below the minimum depth below grade.

In another aspect, the present invention provides a method for on-site wastewater disposal. The method includes the steps of:

(a) selecting a subterraneal volume having a sufficient area for a leach field for a septic system, the selected subterraneal volume including ground water located at a first depth below grade which is less than a minimum depth required for the leach field;

(b) arranging a leach field for effluent from a septic system at least partially within the selected subterraneal volume;

(c) installing a perimeter barrier around the selected subterraneal volume for isolating the selected subterraneal volume around the leach field from adjacent subterraneal volumes; and (d) applying gas at a positive pressure to the subterraneal volume to lower the ground water from the first depth below grade to a level at or below the minimum depth below grade such that the leach field operates in a conventional manner.

In another aspect, the present invention provides a method for on-site wastewater disposal. The method includes the steps of:

(a) selecting a subterraneal volume having a sufficient area for a leach field for a septic system, the selected subterraneal volume including ground water located at a first depth below grade which is less than a minimum depth required for the leach field;

(b) arranging a leach field for effluent from a septic system at least partially within the selected subterraneal volume;

(c) installing a perimeter barrier around the selected subterraneal volume for isolating the selected subterraneal volume around the leach field from adjacent subterraneal volumes;

(d) pumping the ground water from the selected subterraneal volume to lower the depth of the ground water from the first, original depth to a second depth lower than the original depth such that the leach field can operate in a conventional manner; and (e) applying gas at a positive pressure to the subterraneal volume to maintain the ground water at a level which is at or below the minimum depth below grade such that the leach field operates in a conventional manner.

BRIEF DESCRIPTION OF THE SEVERAL VIEWS OF THE DRAWINGS

The foregoing summary, as well as the following detailed description of the preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
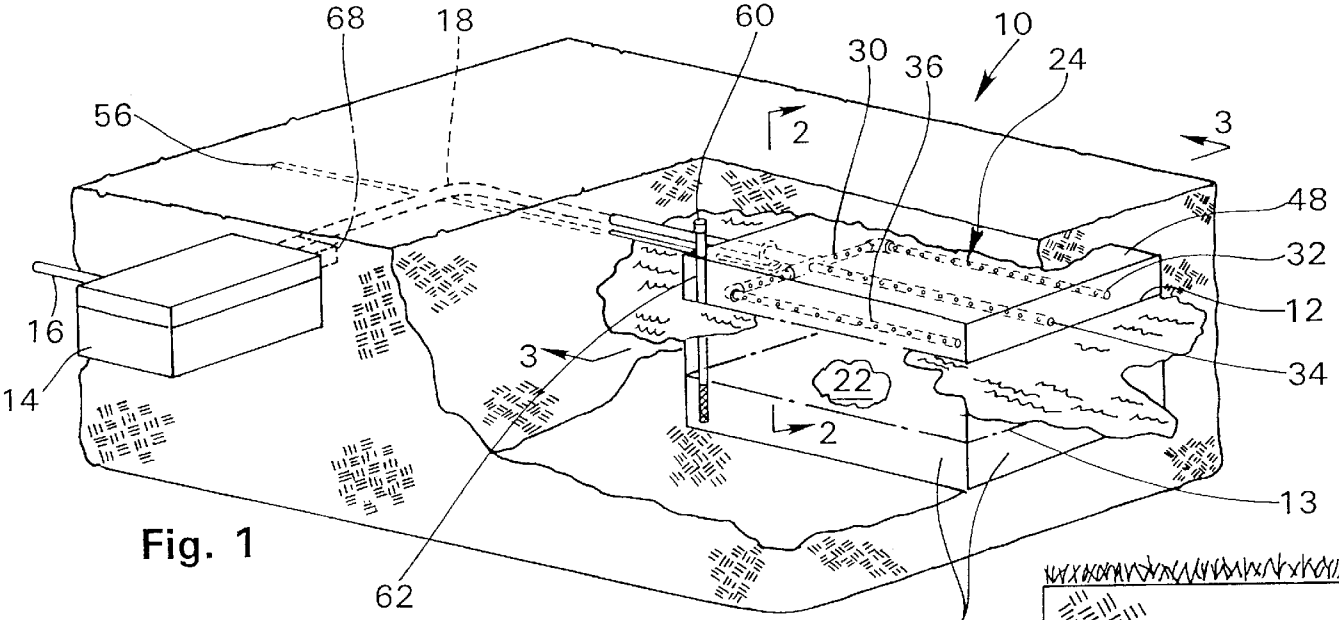
FIG. 1 is a cut-away perspective view of an on-site sewage treatment and disposal system in accordance with the present invention.

Certain terminology is used in the following description for convenience only and is not limiting. The words "right," "left," "lower" and "upper" designate directions in the drawings to which reference is made. The terminology includes the words above specifically mentioned, derivatives thereof and words of similar import.

Referring to the drawings, wherein the same reference numerals are used to indicate the same elements throughout, there is shown in FIG. 1 an on-site sewage treatment and disposal system 10 in accordance with the present invention. The sewage system 10 is for use in areas having a ground water level 12 above a minimum depth below grade, which causes a limiting zone which would otherwise prevent obtaining a permit for installation of a below grade leach field. It will be recognized by those skilled in the art from the present disclosure that the present system 10 can also be used to reduce the required size for a leach field and/or to increase the perc rate of the soil.

The sewage system 10 preferably includes a septic tank 14 which receives wastewater and sewage from a source such as a house (not shown) through a first pipe 16. The septic tank 14 provides for the separation by gravity of gross solids; and also bacteria in the septic tank 14 decomposes and/or digests the raw sewage. A fluid or effluent passes by gravity or pumping from the septic tank 14 via a second pipe 18 to a leach field 24.

Figure 2:
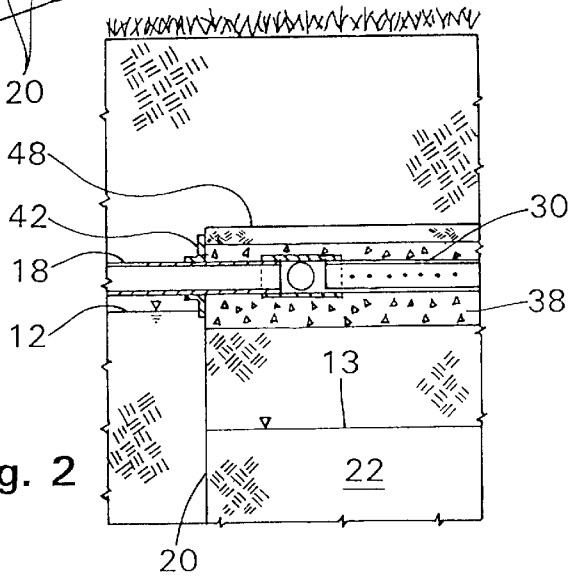
FIG. 2 is a cross-sectional view of the on-site sewage treatment and disposal system taken along lines 2—2 in FIG. 1.
Figure 3:
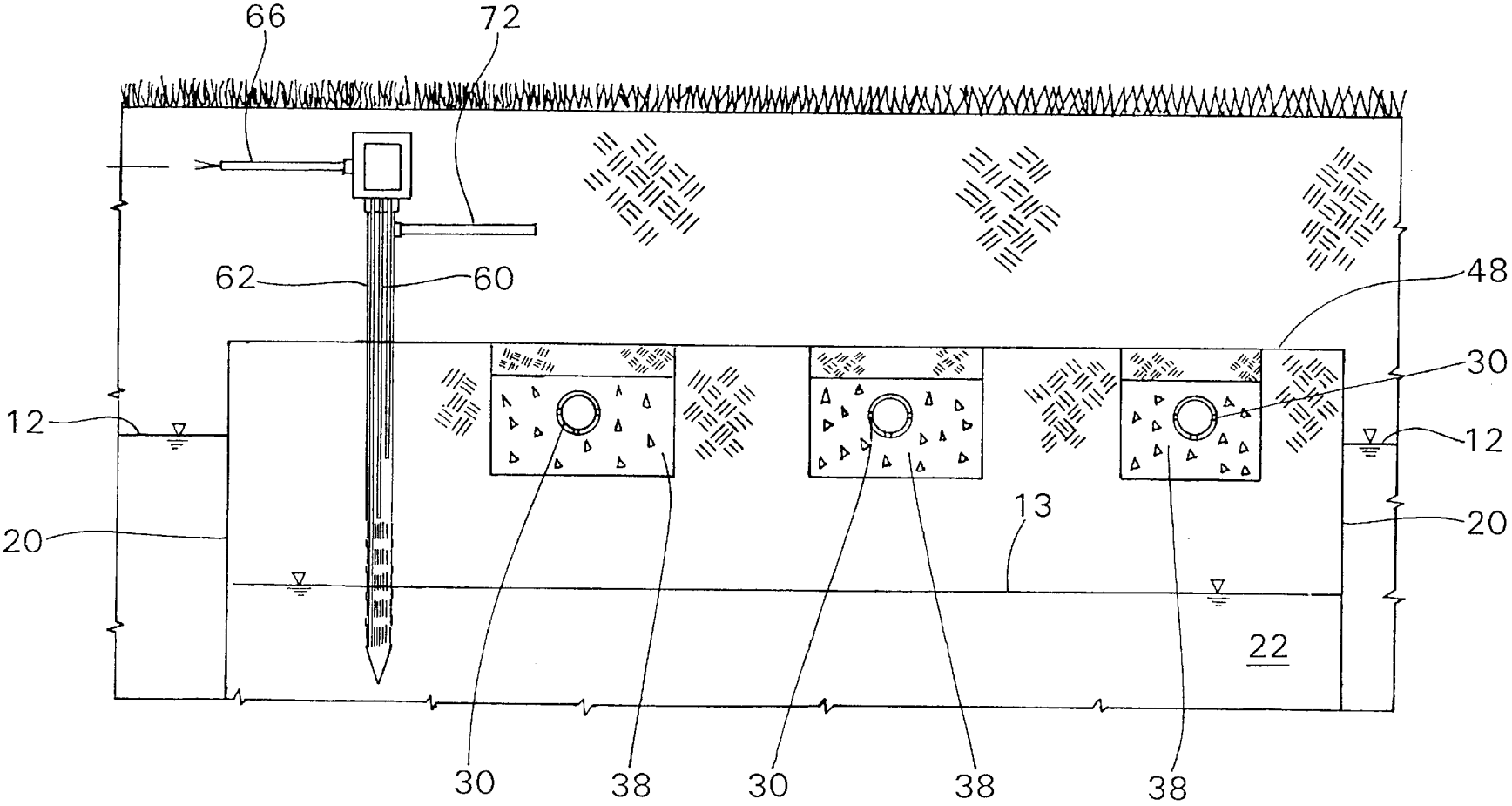
FIG. 3 is a cross-sectional view of the on-site sewage treatment and disposal system taken along lines 3—3 in FIG. 1.

As shown in FIGS. 1–3, a perimeter barrier 20 is arranged around a selected subterraneal volume 22. The selected subterraneal volume 22 is of a sufficient size for containing the leach field 24 for the sewage system 10. The size for the leach field 24 is usually determined based on regulatory agency requirements, the applicable zoning codes, soil type, and perc rate, etc. The perimeter barrier 20 is preferably made of a 30 mil. thick PVC geomembrane and extends to a depth below the minimum required depth for the leach field 24. The perimeter barrier 20 may also be made from other materials such as an HDPE geomembrane, or can be formed as a bentonite slurry wall or a soil cement wall. Alternatively, a clay lining or chemical grouting could be used. It will therefore be recognized by the skilled artisan that the perimeter barrier could be made from any material which creates a barrier around the selected subterraneal volume 22 which is at least partially impermeable to air or gas.

The preferred PVC geomembrane perimeter barrier 20 is preferably installed around the selected subterraneal volume 22 by excavating a trench around the volume 22, or alternatively by excavating the entire subterraneal volume 22. The entire subterraneal volume 22 can be excavated and the soil replaced with a better quality soil for the leach field 24. If a bentonite slurry wall or soil cement is used to create the perimeter barrier 20, it can also be installed by excavation or by injecting the material into a series of wells located around the selected subterraneal volume 22.

A drainage pipe 30 adapted to receive fluid is at least partially located within the selected subterraneal volume 22 inside the perimeter barrier 20. Preferably, the drainage pipe 30 comprises a perforated pipe or drain tiles arranged as a conventional leach field having one or more branches 32, 34, 36 which are located entirely within the selected subterraneal volume 22. Preferably, the drainage pipe 30 is placed in a gravel or crushed stone bed 38 and back-filled with soil, and is sized and installed in the same manner as a conventional leach field. However, it will be understood by those skilled in the art that the drainage pipe 30 and bed 38 refers to any fluid carrying system, such as THE INFILTRATOR® CHAMBER SYSTEM for leach fields, available from INFILTRATOR Systems, Inc., Old Saybrook, Conn., such as described in U.S. Pat. Nos. 5,017,041; 5,156,488 and 5,336,017.

The second pipe 18 from the septic tank 14 is connected to the drainage pipe 30 for directing effluent from the septic tank 14 to the leach field 24. As shown in FIG. 2, preferably a collar 42 is located around the second pipe 18 where it passes through the perimeter barrier 20 to provide a seal between the second pipe 18 and the perimeter barrier 20. In the preferred embodiment, the collar 42 is also made of a PVC material and is solvent welded to the perimeter barrier 20 and the second pipe 18. However, it will be recognized by those skilled in the art that the collar 42 can be made of other suitable materials and can be attached to the perimeter barrier 20 and the second pipe 18 in other manners, such as by an adhesive. Alternatively, the collar 42 can be omitted, if desired, in order to allow some air exchange between the selected subterraneal volume 22 and the adjacent subterraneal volume.

As shown in FIGS. 1–3, preferably, an at least partially gas impermeable cap 48 is located over the drainage pipe 30 used for the leach field 24 in the selected subterraneal volume 22. The cap 48 is preferably made of the same material as the perimeter barrier 20, as noted above. Fill soil is also preferably located over the cap 48. However, it will be recognized by those skilled in the art from the present disclosure that the cap 48 can be made from a variety of other low permeability materials or may omitted, depending on the porosity of the soil.

Figure 4:
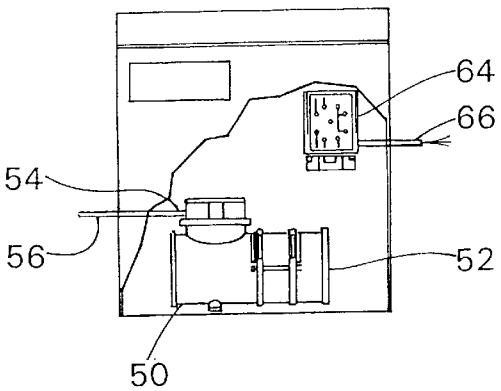
FIG. 4 is an elevational view, partially broken away, of a controller and gas pump for the on-site sewage treatment and disposal system taken of FIG. 1.

Referring now to FIG. 4, preferably a pump 50 having an intake side 52 and a discharge side 54 which discharges gas, which is preferably air, at a pressure greater than atmospheric pressure is provided. Preferably, the pump 50 is located remotely from the selected subterraneal volume 22, such as in the garage or basement of the house connected to the system 10. However, it can be located in an above grade or underground housing located in proximity to the selected subterraneal volume 22. The discharge side 54 of the pump 50 is in fluid communication with the selected subterraneal volume 22, preferably via a third pipe 56, to lower the ground water level 12 within the perimeter barrier 20 to a level 13 at or below the minimum depth below grade required for the leach field 24 to operate in its intended manner.

In the preferred embodiment the pump 50 is a 1/16 horsepower air compressor, such as a Gast Model MOAP101AA. However it will be recognized from the present disclosure that other types of pumps or compressors could be used, if desired.

In the first preferred embodiment 10, the discharge side 54 of the pump 50 is in fluid communication with the subterraneal volume 22 through the drainage pipe 30. The third pipe 56 is preferably used to connect the pump 50 to the drainage pipe 30.

As shown in FIGS. 1 and 3, a level probe 60, which preferably comprises several individual level probes, is positioned within a ground water level monitoring well 62 located within the selected subterraneal volume 22. The level probe 60 is in communication with the pump 50, preferably through wires 66 and the controller 64, shown in FIGS. 3 and 4, which are connected between the level probe 60, the controller 64 and the pump 50, to start and stop the pump 50 based on the ground water level 13 within the perimeter barrier 22 to maintain the ground water 13 within the perimeter barrier 22 at or below the required minimum depth below grade.

The level probe 60 preferably includes several conductance probes. In the preferred embodiment, the level controller is a Warrick Series 16M. However, it will be recognized by those skilled in the art from the present disclosure that other types of level control devices can be used, such as a float actuated switch.

Referring again to FIG. 1, a septic tank effluent pump 68 is preferably in fluid communication with the drainage pipe 30 via the second pipe 18 to provide a positive pressure on the fluid. Effluent pumps are generally known, and the effluent pump 68 used in conjunction with the present invention is the same type used in connection with sand mound leach fields. However, it will be recognized by those skilled in the art from the present disclosure that the effluent pump can be omitted depending on the difference in elevation between the septic tank 14 and the leach field 24 if there is a sufficient head to keep liquid and air from backing up from the drainage pipe 34 to the septic tank 14.

Referring now to FIG. 3, preferably the system 10 includes means for fresh air exchange with the soil located in the selected subterraneal volume 22. The fresh air exchange means is preferably a perforated pipe 72 connected to the monitoring well 62. The perforated pipe 72 allows air within the selected subterraneal barrier to exit the area enclosed by the perimeter barrier 20 and the cap 48 through the monitoring well 62 and the perforated pipe 72 into the surrounding soil. The air is replaced by fresh air from the pump 50 which is forced into the selected subterraneal volume 22 via the third pipe 56 and the drainage pipes 30. This provides needed oxygen for aerobic organisms located in the soil within the selected subterraneal space 22.

It will be recognized by those skilled in the art from the present disclosure that the fresh air exchange could be provided in other manners, such as a separate pipe from the selected subterraneal volume 22, or a permeable portion located in the perimeter barrier 20 or the cap 48. It will also be recognized by those skilled in the art from the present disclosure that the air exchange system need not be provided if treatment of effluent by anoxic or anaerobic organisms is desired. Without fresh air exchange, organisms which require oxygen will die off and anoxic and/or anaerobic organisms will multiple in numbers. Such systems can be used to treat nitrates in order to prevent them from being discharged into the ground water.

Figure 5:
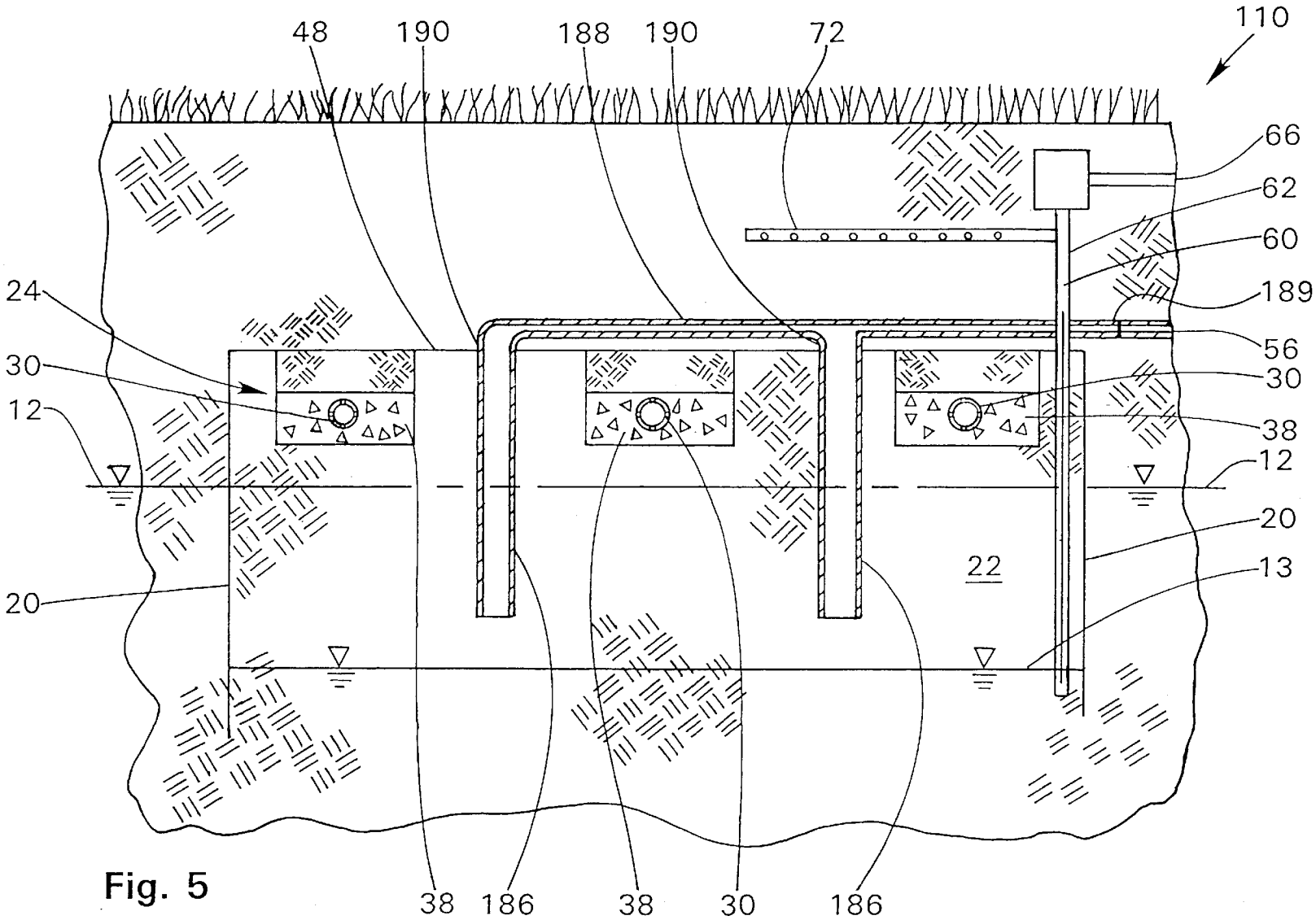
FIG. 5 is a cross-sectional view of a sewage treatment and disposal system in accordance with a second embodiment of the invention.

Referring now to FIG. 5, a second embodiment of an on-site sewage treatment and disposal system 110 for use in areas having a ground water level above a minimum depth below grade is shown. The system 110 in accordance with the second embodiment is similar to the system 10 in accordance with the first preferred embodiment 10 and like elements have been designated with the same reference numerals. The differences between the system 110 in accordance with the second embodiment from the system 10 in accordance with the first embodiment are explained below.

As shown in FIG. 5, the system 110 includes a plurality of vertical wells 186 located in the subterraneal volume 22. A manifold 188 having an inlet 189 is connected to the wells. The inlet 189 is connected to the pump discharge side 54 via the third pipe 56. The manifold further includes a plurality of outlets 190 connected to the plurality of wells 186 for discharging gas from the pump 50 at a pressure greater than atmospheric pressure into the selected subterraneal volume 22 to lower the ground water level 13 within the perimeter barrier to a level at or below the minimum required depth below grade in order to allow the leach field 24 to operate in a conventional manner.

The operation of the first and second systems 10, 110 is similar. Effluent from the septic tank 14 is pumped by effluent pump 68 through the second pipe 18 to the drainage pipe 30 for the leach field 24. The effluent is distributed through the one or more branches 32, 34, 36 of the leach field 24 which are located within the selected subterraneal volume 22 enclosed by the perimeter barrier 20, and preferably by the cap 48. The pump 50 provides gas, preferably air, at higher than atmospheric pressure through the third pipe 56 to the drainage lines 30 in the first preferred embodiment of the septic system 10 and through the manifold 188 to the wells 186 in the selective subterraneal volume 22 in the second preferred embodiment 110. The air at higher than atmospheric pressure lowers the ground water from the first depth below grade 12 to a level 13 at or below the minimum depth below grade such that the leach field 24 operates in a conventional manner with the required thickness of unsaturated soils within the leach field. The effluent pump 68 prevents effluent from being forced back up the second pipe 18 due to the pressure caused by the gas pump 50. The effluent in the leach field 24 is absorbed into the earth where additional treatment takes place as the effluent migrates downwardly toward the lowered ground water level 13.

The level probe 60 located in the monitoring well 62 is connected to the controller 64 to turn the pump 50 on and off in order to maintain sufficient gas pressure within the selective subterraneal volume 22 to maintain the ground water within the perimeter barrier 20 at the level 13 which is at or below the required minimum depth below grade. In order to prevent the pump 50 from constantly cycling, the level probe 60 and/or the controller 64 can be set to turn the pump 50 on when the ground water level 13 within the perimeter barrier 20 reaches the minimum required depth below grade for the leach field 24, and turns the pump 50 off when the ground water level 13 located within the perimeter barrier 20 is lowered by an additional amount such that several hours or more time elapses before the controller 64 cycles the pump on. This should prevent unnecessarily frequent cycling of the pump 50 while maintaining the ground water level 13 within the perimeter barrier 20 at or below the required depth.

Fresh air exchange in the selected subterraneal volume 22 is preferably provided via the air exchange pipe 72 connected the monitoring well 62 which allows to be forced through the soil into the monitoring well and upwardly to escape through the exchange pipe 72 into the adjacent subterraneal space.

Figure 6:
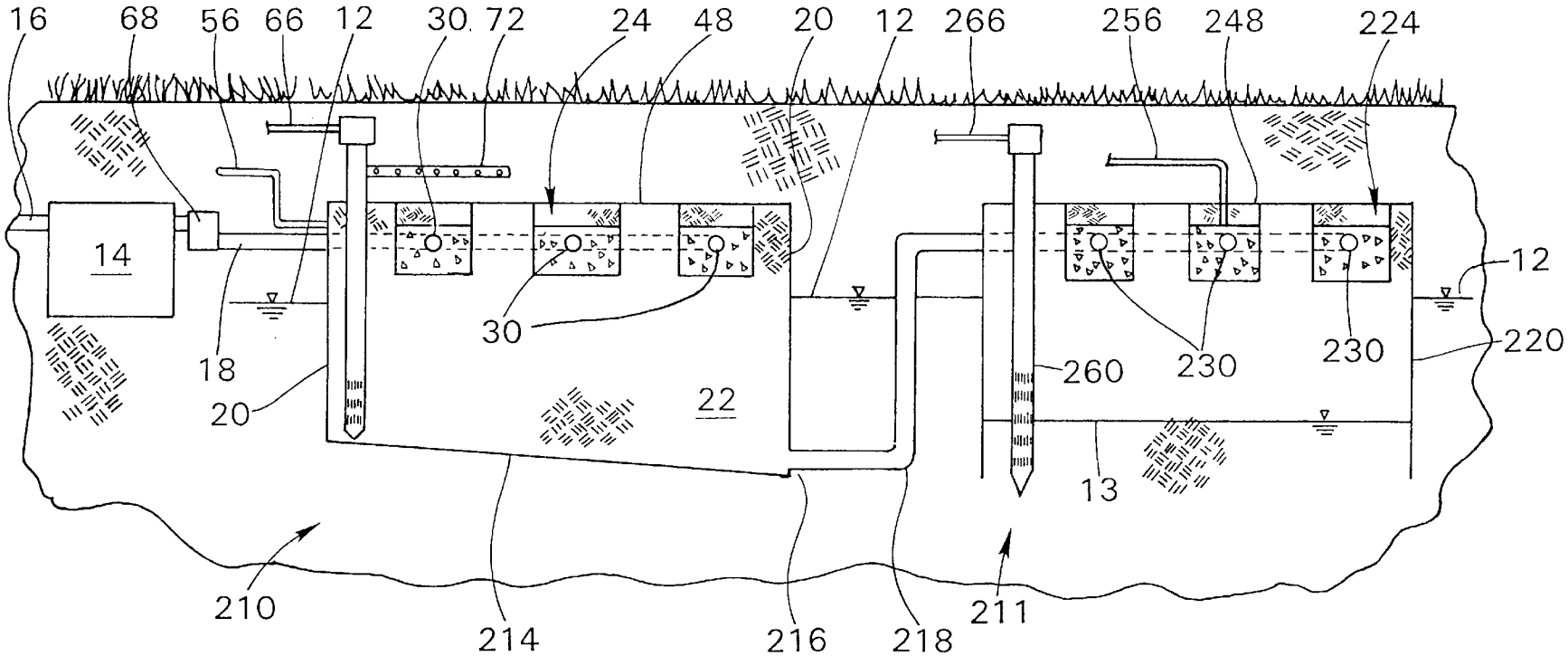
FIG. 6 is a cross-sectional view of a sewage treatment and disposal system in accordance with a third embodiment of the invention.

Referring now to FIG. 6, a third embodiment of a treatment system 210 in accordance with the present invention is shown. The system 210 in accordance with the third embodiment of the invention is similar to the system 10 in accordance with the first embodiment of the invention and like elements have been identified with the same reference numerals.

In the third preferred embodiment, sewage from the household flows through the first pipe 16 into the septic tank 14 where the solid matter is separated from liquid and anaerobic bacterial action decomposes the raw sewage.

Fluid exits the septic tank 14 through the second pipe 18 and is pumped by an effluent pump 68 to the leach field 24 having drainage pipes 30 within the selected subterraneal volume 22. Preferably, a water or treated effluent collection member 214 is located below the selected subterraneal volume 22. Preferably, the collection member is made of 30 mil. thick PVC geomembrane, and is sloped to a collection site 216. However, the effluent collection member 214 may be formed of materials having a sufficient permeability contrast, such as pea gravel over a sand bed, such that the fluid travels through the pea gravel to the collection site 216 instead of migrating downwardly through the sand.

The collection member 214 is preferably installed by excavating the selected subterraneal volume and installing the 30 mil. thick PVC geomembrane on the bottom. The perimeter barrier 20 is also preferably installed prior to back filling with soil. If the soil quality is poor, the soil used to back fill can be augmented with carbon source material, such as peat, or replaced with a better quality soil for the leach field. The leach field 24 is then installed in the same manner described in conjunction with the first embodiment.

An intermediate pipe 218 is connected between the collection site 216 and the inlet of a leach field 224 for a nitrate treatment system 211. The nitrate treatment system 211 is identical to the system 10 described above in connection with the first embodiment of the invention except that no fresh air exchange is provided, and includes a perimeter barrier 220 arranged around a second selected subterraneal volume 222, and preferably a cap 248 for reducing the ground water level 12 to a minimum depth below grade.

Preferably, the leach field 224 is similar to the leach field 24 in accordance with the first embodiment of the invention and is arranged in a similar manner, and is made from perforated drainage pipe or tiles 230, which is similar to the drainage pipe 30, noted above.

No fresh air exchange is provided for the nitrate treatment system 211, and the second selected subterraneal volume 222 becomes oxygen depleted, allowing anoxic and/or anaerobic organisms which are used for the treatment of nitrates to thrive.

Pressurized air is pumped through a pipe 256 into the drainage pipe 230 to lower the ground water level 13 within the perimeter barrier 220 to a level at or below the minimum depth below grade required for the system to operate for nitrate treatment. The water level is monitored by a second level control 260 in communication via wires 266 with a second pump, similar to the pump 50. The second pump is cycled off and on, in a similar manner to the pump 50, to maintain the ground water level 13 below the minimum required depth below grade. Alteratively, the ground water level in both enclosed subterraneal volumes 20, 220 can be controlled by a single gas or air pump 50, with both being pressurized at the same time, or controllable valves used to direct the pressurized air flow from the discharge side 54 of the pump 50 to the appropriate subterraneal volume 20, 220.

It will be recognized by those skilled art from the present disclosure that pressure in the first selected subterraneal volume 22 will cause the fluid collected by the collection member 214 to flow through the transfer pipe 218 into the leach field 224 of the nitrate treatment system 211. Alternatively, a pump (not shown) can be provided in the transfer pipe 218 for transferring fluid to the leach field 224 located within the perimeter barrier 220 surrounding the second selected subterraneal volume 222.

It will be recognized by those skilled in the art from the present disclosure that the nitrate treatment system 211 can be used independently of the system 210, if desired, in order to treat nitrates in any water source. It will be similarly recognized that the system 211 can be used for treatment of fluid using other anoxic and/or anaerobic organisms.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An on-site sewage treatment and disposal system for areas having a ground water level above a minimum depth below grade comprising:

a perimeter barrier arranged around a selected subterraneal volume;

a drainage pipe adapted to receive fluid, the drainage pipe being at least partially located within the selected subterraneal volume inside the perimeter barrier;

a pump having a gas intake and a discharge side which discharges gas at a pressure greater than atmospheric pressure, the discharge side of the pump being in fluid communication with the selected subterraneal volume to lower the ground water level within the perimeter barrier to a level at or below the minimum depth below grade.

2. The treatment system of claim 1 further comprising an at least partially gas impermeable cap located above the drainage pipe in the selected subterraneal volume.

3. The treatment system of claim 2 further comprising fill soil located over the cap.

4. The treatment system of claim 1 wherein the discharge side of the pump is in fluid communication with the subterraneal volume through the drainage pipe.

5. The treatment system of claim 1 wherein a plurality of wells are located in the subterraneal volume, and the system further comprises a manifold having an inlet connected to the pump discharge side, and a plurality of outlets connected to the plurality of wells.

6. The treatment system of claim 1 further comprising a septic tank effluent pump in fluid communication with the drainage pipe to provide a positive pressure on the fluid.

7. The treatment system of claim 1 further comprising a level probe adapted to be positioned within a ground water level monitoring well located within the selected subterraneal volume, the level control being in communication with the pump to start and stop the gas flow from the pump based on the ground water level within the perimeter barrier to maintain the ground water within the perimeter barrier at or below the minimum depth below grade.

8. The treatment system of claim 6 wherein the level probe is a conductance probe.

9. The treatment system of claim 1 wherein the perimeter barrier comprises one of a PVC geomembrane, an HDPE geomembrane, a bentonite slurry wall, clay, a soil cement wall, and a chemical grout wall.

10. The treatment system of claim 2 wherein the cap comprises one of a PVC geomembrane, an HDPE geomembrane, a bentonite slurry barrier, clay, a soil cement barrier, and a chemical grout barrier.

11. A method for on-site wastewater disposal, comprising the steps of:

(a) selecting a subterraneal volume having a sufficient area for a leach field for a septic system, the selected subterraneal volume including ground water located at a first depth below grade which is less than a minimum depth required for the leach field;

(b) arranging a leach field for effluent from a septic system at least partially within the selected subterraneal volume;

(c) installing a perimeter barrier around the selected subterraneal volume for isolating the selected subterraneal volume around the leach field from adjacent subterraneal volumes; and (d) applying gas at a positive pressure to the subterraneal volume to lower the ground water from the first depth below grade to a level at or below the minimum depth below grade such that the leach field operates in a conventional manner.

12. The method of claim 11 wherein the perimeter barrier includes a top most edge and a bottom most edge, the method further comprising the step of arranging the perimeter barrier such that the bottom most edge extends below the second depth of the ground water for allowing the leach field to operate in the conventional manner to form a hydraulic seal between the ground water and the perimeter barrier.

13. The method of claim 11 further comprising the step of arranging a cap over the leach field in the subterraneal volume to maintain the positive pressure in the selected subterraneal volume.

14. The method of claim 11 further comprising the steps of drilling through soil in said selected subterraneal volume to create at least one well for applying the positive pressure to the subterraneal volume, and connecting a gas port for applying the gas at the positive pressure to the well to displace ground water from the original depth to the suitable depth to allow the leach field to operate in the conventional manner.

15. The method of claim 11 further comprising the steps of providing a pipe for effluent to flow from a septic tank through the perimeter barrier to the leach field, and providing positive pressure on the effluent flow in the pipe to prevent reverse flow of effluent and air.

16. A method for on-site wastewater disposal, comprising the steps of:

(a) selecting a subterraneal volume having a sufficient area for a leach field for a septic system, the selected subterraneal volume including ground water located at a first depth below grade which is less than a minimum depth required for the leach field;

(b) arranging a leach field for effluent from a septic system at least partially within the selected subterraneal volume;

(c) installing a perimeter barrier around the selected subterraneal volume for isolating the selected subterraneal volume around the leach field from adjacent subterraneal volumes;

(d) pumping the ground water from the selected subterraneal volume to lower the depth of the ground water from the first, original depth to a second depth lower than the original depth such that the leach field can operate in a conventional manner; and (e) applying gas at a positive pressure to the subterraneal volume to lower the ground water from the first depth below grade to a level at or below the minimum depth below grade such that the leach field operates in a conventional manner.

17. The method of claim 16 wherein the perimeter barrier includes a top edge and a bottom edge, the method further comprising the step of arranging the perimeter barrier such that the bottom edge extends below the second depth of the ground water to form a hydraulic seal between the ground water and the perimeter barrier.

18. The method of claim 16 further comprising the step of arranging a cap over the leach field in the subterraneal volume to maintain the positive pressure.

19. The method of claim 16 further comprising the steps of drilling through soil in said subterraneal volume to create at least one well for applying the positive pressure to the subterraneal volume, and connecting a gas port for applying the gas at the positive pressure to the well to displace ground water from the first, original depth to the second depth to allow the leach field to operate in the conventional manner.

20. The method of claim 16 further comprising the steps of providing a pipe for effluent to flow from a septic tank through the perimeter barrier to the leach field, and providing positive pressure on the effluent flow in the pipe to prevent reverse flow of the effluent.

* * * * *